US008117720B2

(12) United States Patent
Kimes

(10) Patent No.: US 8,117,720 B2
(45) Date of Patent: Feb. 21, 2012

(54) ROTARY TENSIONING DEVICE

(75) Inventor: Ashley Kimes, Irvine, CA (US)

(73) Assignee: Ossur HF, Reykjavik (IS)

( * ) Notice: Subject to any disclaimer, the term of this patent is extended or adjusted under 35 U.S.C. 154(b) by 211 days.

(21) Appl. No.: 12/547,694

(22) Filed: Aug. 26, 2009

(65) Prior Publication Data

US 2010/0050403 A1 Mar. 4, 2010

Related U.S. Application Data

(60) Provisional application No. 61/092,279, filed on Aug. 27, 2008.

(51) Int. Cl.
*A43C 11/00* (2006.01)
*B65H 75/30* (2006.01)
*B25B 25/00* (2006.01)

(52) U.S. Cl. ..... 24/68 B; 24/68 SK; 242/395.1

(58) Field of Classification Search ..... 24/68 B, 24/71.1, 68 CD, 68 SK, 68 BT; 242/388, 242/388.1, 388.2, 388.3, 388.4; 254/213, 254/214, 223, 241
See application file for complete search history.

(56) References Cited

U.S. PATENT DOCUMENTS 3,311,319 A * 3/1967 Campbell ..... 242/394
3,516,382 A * 6/1970 Ferraro ..... 116/298
4,620,378 A 11/1986 Sartor
4,633,599 A 1/1987 Morell et al.
4,660,300 A 4/1987 Morell et al.
4,719,710 A 1/1988 Pozzobon
4,741,115 A 5/1988 Pozzobon
4,748,726 A 6/1988 Schoch
4,760,653 A 8/1988 Baggio
4,841,649 A 6/1989 Baggio et al.
4,884,760 A 12/1989 Baggio et al.
4,961,544 A 10/1990 Bidoia
5,042,177 A 8/1991 Schoch
5,062,225 A 11/1991 Gorza
5,065,481 A 11/1991 Walkhoff
5,152,038 A 10/1992 Schoch (Continued)

FOREIGN PATENT DOCUMENTS

DE 2341658 8/1972

(Continued)

OTHER PUBLICATIONS

Rollerblade TFS Skate Laces AERO <http://www.inlinewarehouse.com/viewlarge.html?PCODE=TFS>.

(Continued)

*Primary Examiner* — Robert J Sandy
*Assistant Examiner* — Louis Mercado
(74) *Attorney, Agent, or Firm* — Bacon & Thomas, PLLC

(57) ABSTRACT

A rotary tensioning device that is low profile when not being used to apply or reduce tension and that provides an easily manipulated tightening and loosening control mechanism. A control mechanism in the form of a flip up handle is pivotally connected to a drive member and rotation of the handle and drive member rotates a driven member connected to a spool to take up or let out a cable or wire to apply or reduce tension in the cable or wire. When not being used to apply or reduce tension, the flip up handle is pivoted to lie flush against a housing of the spool to provide a low profile. A tension indicating device provides a user with a mechanism for reproducing tensions between uses.

6 Claims, 6 Drawing Sheets

U.S. PATENT DOCUMENTS

| | | | | |
|---|---|---|---|---|
| 5,157,813 | A | 10/1992 | Carroll | |
| 5,249,377 | A | 10/1993 | Walkhoff | |
| 5,325,613 | A | 7/1994 | Sussmann | |
| 5,388,877 | A * | 2/1995 | Wenk | 294/1.1 |
| 5,477,593 | A | 12/1995 | Leick | |
| 5,647,104 | A | 7/1997 | James | |
| 5,819,378 | A | 10/1998 | Doyle | |
| 5,934,599 | A | 8/1999 | Hammerslag | |
| 6,202,953 | B1 | 3/2001 | Hammerslag | |
| 6,289,558 | B1 | 9/2001 | Hammerslag | |
| D519,637 | S | 4/2006 | Nordt et al. | |
| D520,141 | S | 5/2006 | Nordt et al. | |
| D521,644 | S | 5/2006 | Nordt et al. | |
| 7,281,341 | B2 | 10/2007 | Reagan et al. | |
| 7,374,125 | B2 * | 5/2008 | Lin | 242/395 |
| 7,591,050 | B2 | 9/2009 | Hammerslag | |
| 7,874,955 | B2 * | 1/2011 | Patterson | 475/259 |
| 2002/0095750 | A1 | 7/2002 | Hammerslag | |
| 2002/0141755 | A1 * | 10/2002 | Manabe | 396/536 |
| 2003/0093882 | A1 | 5/2003 | Gorza et al. | |
| 2003/0204938 | A1 | 11/2003 | Hammerslag | |
| 2005/0247813 | A1 | 11/2005 | Kovacevich et al. | |
| 2006/0015980 | A1 | 1/2006 | Nordt, III et al. | |
| 2006/0015988 | A1 | 1/2006 | Philpott et al. | |
| 2006/0020237 | A1 | 1/2006 | Nordt, III et al. | |
| 2006/0026732 | A1 | 2/2006 | Nordt, III et al. | |
| 2006/0026733 | A1 | 2/2006 | Nordt, III et al. | |
| 2006/0026736 | A1 | 2/2006 | Nordt, III et al. | |
| 2006/0030802 | A1 | 2/2006 | Nordt, III et al. | |
| 2006/0030803 | A1 | 2/2006 | Nordt, III et al. | |
| 2006/0030804 | A1 | 2/2006 | Nordt, III et al. | |
| 2006/0030805 | A1 | 2/2006 | Nordt, III et al. | |
| 2006/0030806 | A1 | 2/2006 | Nordt, III et al. | |
| 2006/0070164 | A1 | 4/2006 | Nordt, III et al. | |
| 2006/0070165 | A1 | 4/2006 | Nordt, III et al. | |
| 2006/0156517 | A1 | 7/2006 | Hammerslag et al. | |
| 2006/0185357 | A1 | 8/2006 | Kovacevich et al. | |
| 2006/0202077 | A1 | 9/2006 | Kovacevich et al. | |
| 2006/0202078 | A1 | 9/2006 | Kovacevich et al. | |
| 2007/0039085 | A1 | 2/2007 | Kovacevich et al. | |
| 2007/0169378 | A1 | 7/2007 | Sodeberg et al. | |
| 2008/0034459 | A1 | 2/2008 | Nordt, III et al. | |
| 2008/0039757 | A1 | 2/2008 | Nordt, III et al. | |
| 2008/0039764 | A1 | 2/2008 | Nordt, III et al. | |
| 2008/0039765 | A1 | 2/2008 | Nordt, III et al. | |
| 2008/0039767 | A1 | 2/2008 | Nordt, III et al. | |
| 2008/0060167 | A1 | 3/2008 | Hammerslag et al. | |
| 2008/0060168 | A1 | 3/2008 | Hammerslag et al. | |
| 2008/0066272 | A1 | 3/2008 | Hammerslag et al. | |
| 2008/0066345 | A1 | 3/2008 | Hammerslag et al. | |
| 2008/0066346 | A1 | 3/2008 | Hammerslag et al. | |
| 2008/0083135 | A1 | 4/2008 | Hammerslag et al. | |

FOREIGN PATENT DOCUMENTS

| | | |
|---|---|---|
| EP | 0201051 | 11/1986 |
| FR | 2177294 | 11/1973 |
| FR | 2399811 | 3/1979 |
| WO | WO2007/016983 | 2/2007 |

OTHER PUBLICATIONS

Rollerblade TFS Skate Laces MICRO <http://www.inlinewarehouse.com/viewlarge.html?PCODE= TFS>.

* cited by examiner

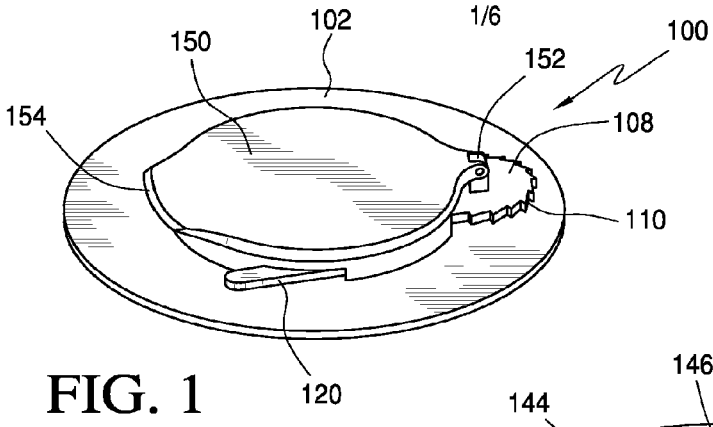
FIG. 1
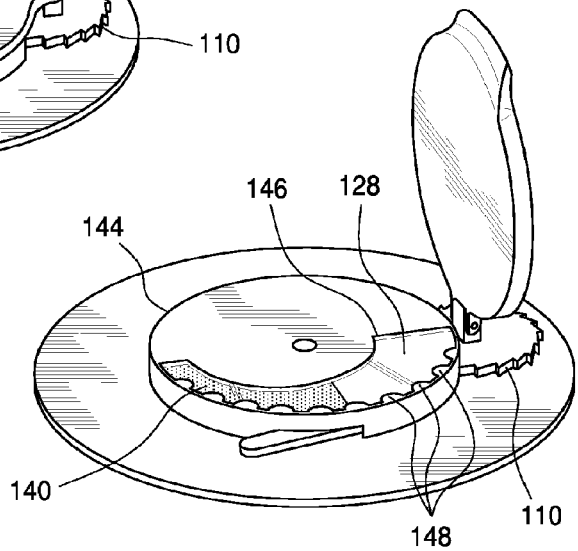
FIG. 2
FIG. 3
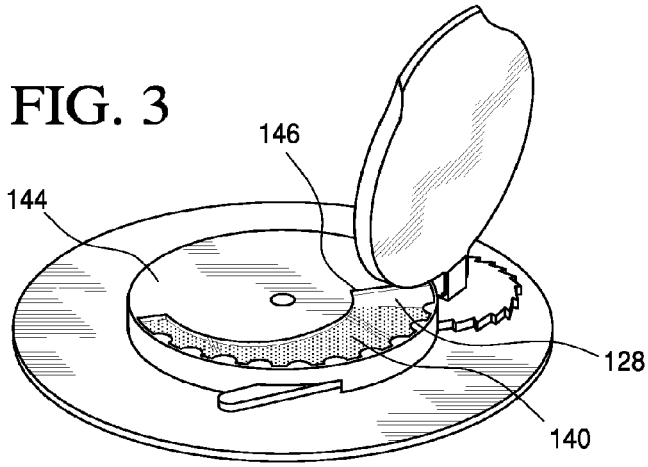
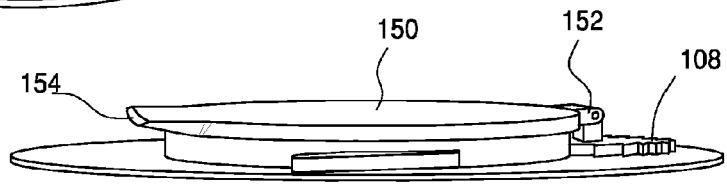
FIG. 4

FIG. 16
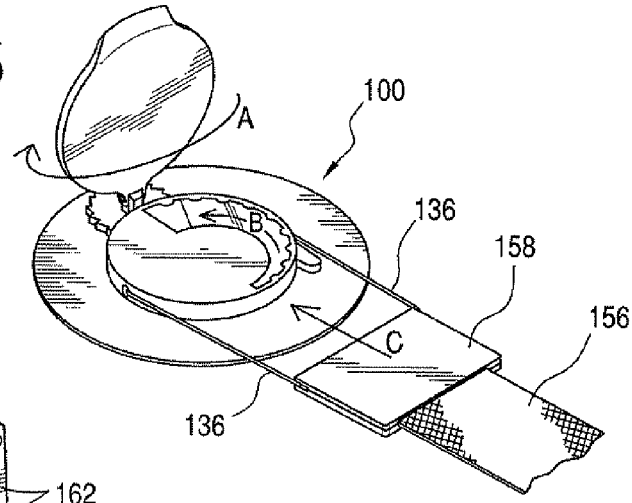
FIG. 17
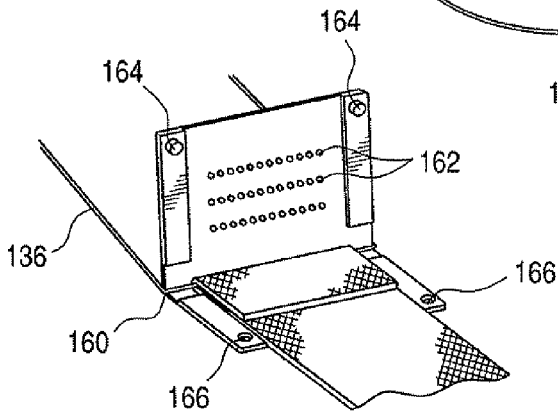
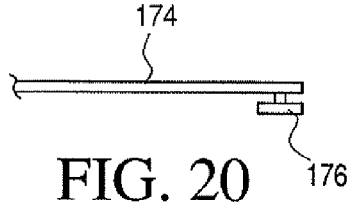
FIG. 20
FIG. 19
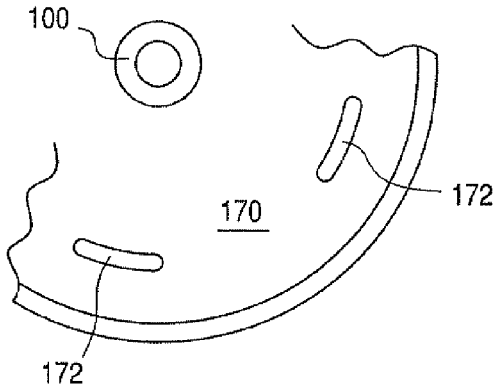
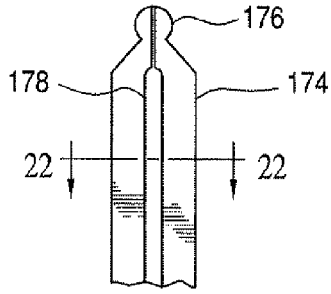
FIG. 21
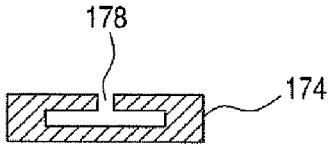
FIG. 22

ROTARY TENSIONING DEVICE

This application claims the benefit of U.S. Provisional Application No. 61/092,279, filed Aug. 27, 2008.

FIELD OF THE INVENTION

The present invention relates generally to the field of rotary tensioning devices, and more particularly to a rotary tensioning device used to tension straps of a device, such as, for example, wearable devices such as clothing, boots/shoes, protective devices, orthopedic devices, or prosthetic devices.

BACKGROUND

Rotary tensioning devices are used to provide relatively quick adjustment and tensioning of boots, shoes, or other devices, by running a cable or wire through cable guides positioned along opposed portions of the device to be drawn towards each other. Rotation of a knob in a first direction draws up the cable or wire to provide tension and rotation of the knob in a second direction lets out the cable or wire to reduce tension.

However, the knobs of typical rotary tensioning devices have a substantial size such that they project from the device to which the tensioning device is attached, such that the knob may catch on objects. Thus, the knob may be damaged, or the wearer may be injured from falling due to loss of balance caused by interaction of the knob with other objects.

Therefore, it is desirable to provide a low profile rotary tensioning device. However, some people, in particular elderly or infirm persons, may have difficulty manipulating a low profile knob, since such a low profile knob will not have much surface area for a wearer or user to grip.

It is also desirable to provide an indication of the amount of tension being applied so that a user or wearer can obtain reproducible amounts of tension with each use of the device.

The embodiments of the present disclosure provide a rotary tensioning device that is low profile when not being used to apply or reduce tension, but which is easier for any user, in particular elderly or infirm persons, to manipulate. Further, the disclosed embodiments of a rotary tensioning device utilize an indication system that provides a user with information to reproduce applied tensions between each subsequent use.

SUMMARY

A rotary tensioning device that is low profile when not being used to apply or reduce tension and that provides an easily manipulated tightening and loosening control mechanism is disclosed. A flip up handle is pivotally connected to a drive member and rotation of the handle and drive member rotates a driven member connected to a spool to take up or let out a cable or wire to apply or reduce tension in the cable or wire. When not being used to apply or reduce tension, the flip up handle is pivoted to lie flush against a housing of the spool to provide a low profile. A tension indicating device provides a user with a mechanism for reproducing tensions between uses.

The rotary tensioning device can include a base portion and a drive member rotatably positioned on the base portion. A driven member is also rotatably positioned on the base portion and is further configured to be rotated by rotation of the drive member. A housing at least partially surrounds the driven member. A handle is pivotally connected to the drive member and is configured to lie flush against the housing in a non-use position and is further configured to rotate the drive member in a use position.

The rotary tensioning device can also include a selectively releasable lock member configured to allow free rotation of the driven member in a first direction and to selectively allow or prevent rotation of the driven member in a second direction. The lock member can be in the form a pivoting lever that can be manipulated to pivot to an unlocked position and is biased to return to a lock position.

An indicator member that is rotatable with the driven member and visible through a view portion of the housing can be provided to indicate dosage or amount of tension in order to allow a user to reproduce the tension applied between succeeding uses.

The numerous advantages, features and functions of the various embodiments of a low profile rotary tensioning device will become readily apparent and better understood in view of the following description and accompanying drawings. The following description is not intended to limit the scope of the rotary tensioning device, but instead merely provides exemplary embodiments for ease of understanding.

BRIEF DESCRIPTION OF THE DRAWINGS

FIG. 1 is a perspective view of one embodiment of a rotary tensioning device according to the disclosure, with the control mechanism in a non-use position;

FIG. 2 is a perspective view of the embodiment of FIG. 1 with the control mechanism in a first use position;

FIG. 3 is a perspective view of the embodiment of FIG. 1 with the control mechanism in a second use position;

FIG. 4 is a front perspective view of the embodiment of FIG. 1 with the control mechanism in the non-use position;

FIG. 16 is a perspective view of a variation of the rotary tensioning device of FIG. 1 shown in combination with a strap to be tightened;

FIG. 17 is an expanded view of the strap of FIG. 16;

FIG. 19 is a variation of the support member shown in FIG. 18;

FIG. 20 is a side view of the mounts of FIG. 18;

FIG. 21 is a top view of the mounts of FIG. 18;

FIG. 22 is a sectional view taken along line 22-22 of FIG. 21.

Figure 5:
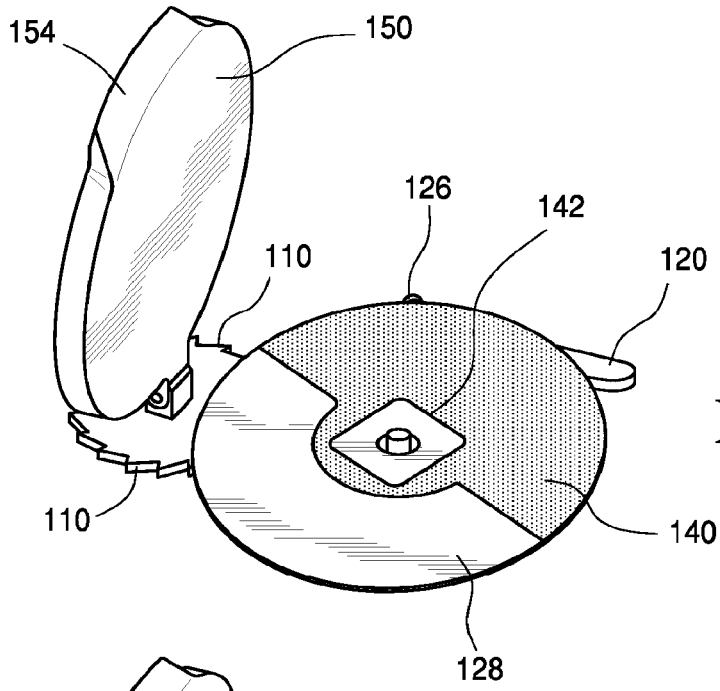
FIG. 5 is a perspective view of the control mechanism and spool of the embodiment of FIG. 1.

In the various figures, similar elements are provided with similar reference numbers. It should be noted that the drawing figures are not necessarily drawn to scale, but instead are drawn to provide a better understanding of the components thereof, and are not intended to be limiting in scope, but rather provide exemplary illustrations. It should also be noted that the features illustrated in a particular drawing may be utilized in an appropriate manner with any other suitable drawing figure. It should further be noted that the figures illustrate exemplary embodiments of a rotary tensioning device, and in no way limit the structures or configurations of a rotary tensioning device according to the present disclosure.

DETAILED DESCRIPTION OF VARIOUS EMBODIMENTS

A. Environment and Context of the Various Embodiments

The rotary tensioning devices described herein have many applications. For example, as described herein, the rotary tensioning device may be used in combination with one or more straps, which straps are connected to a cable or wire to be drawn up by the rotary tensioning device. The straps will typically be fixed at an end opposed to the end connected to the cable or wire, such that rotation of the rotary tensioning device in a first direction will build tension in the straps and rotation of the rotary tensioning device in a second direction will loosen the straps.

Such straps may be used in any suitable application, such as, for example, wearable items such as clothing, boots/shoes, protective devices, orthopedic devices, or prosthetic devices. The straps may also be used in any other application where strap tightening is desired, such as, for example, in securing items for transport or storage. Other uses of the rotary tensioning device in combination with a strap can include utilizing the rotary tensioning device and strap to adjust a varus/valgus angle, or other angles and orientations of an orthopedic device or as an adjustment mechanism for range of motion (ROM) of a hinge of an orthopedic device. The disclosed rotary tensioning devices are not to be limited for use in any particular environment, but may be used in any suitable environment where it is desired to provide reproducible tension to a device. It is also contemplated that the disclosed rotary tensioning devices can be used to provide tension to items other than straps.

As used herein, the words "cable" and "wire" are used interchangeably and have their ordinary meanings and refer to relatively long and relatively thin shaped metals, polymers, natural fibers, or any other suitable material, which may be single strand or multi-strand, and which may include friction reducing coatings thereon.

B. Detailed Description of a Rotary Tensioning Device

Referring to FIGS. 1-11, an embodiment of a rotary tensioning device 100 is illustrated. The rotary tensioning device 100 can be formed from any desired materials that are suitable for their intended purposes. For example, the components of the rotary tensioning device 100 can be formed from any suitable metals, plastics, composite materials, or any combination thereof.

The rotary tensioning device 100 includes a base 102, which may be a self contained structure suitable for connection to an additional item, or which may be integrated into the structure of an additional item. For example, if the rotary tensioning device 100 is to be used as a component of an orthopedic brace, the base 102 may be integrated with the support structure of such an orthopedic brace. Alternatively, the base 102 can be separately formed and adhered or connected to the support structure of an orthopedic brace via suitable mechanisms, such as any type of welding, any type of mechanical connection, or in any other suitable manner.

The base 102 provides a supporting mechanism for the remaining components of the rotary tensioning device 100. In particular, a first axle (not shown) and a second axle 106 are provided with the base 102.

Figure 6:
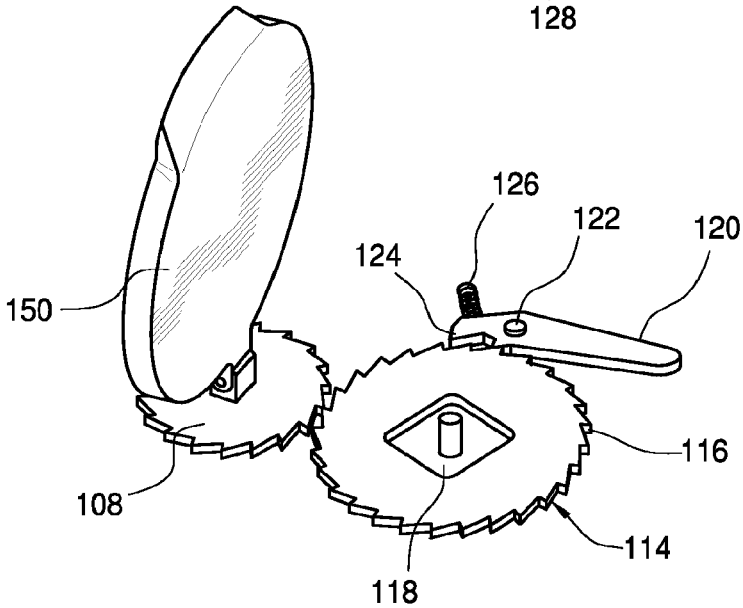
FIG. 6 is a perspective view of the control mechanism, driven member, and lock member of the embodiment of FIG. 1.
Figure 7:
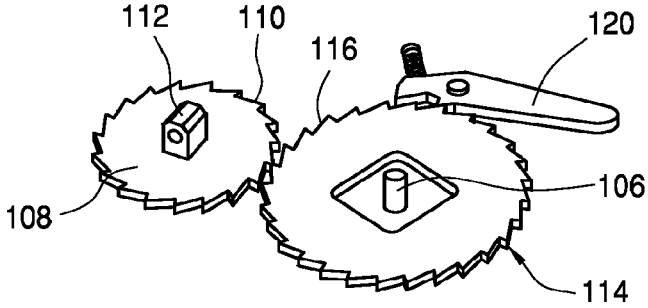
FIG. 7 is a perspective view of the drive member, driven member, and lock member of the embodiment of FIG. 1.

As shown best in FIGS. 6 and 7, the axles provide rotation points for a drive member 108 and a driven member 114. Each of the drive member 108 and the driven member 114 are respectively provided with projections or teeth 110, 116. The projections or teeth 116 of the driven member 114 are correspondingly shaped to the projections or teeth 110 of the drive member 108. Therefore, rotation of the drive member 108 in a first direction causes a corresponding rotation of the driven member 114 in a first direction, and rotation of either the drive member 108 or the driven member 114 in a second direction causes a corresponding rotation of the corresponding drive member 108 or driven member 114 in a second direction.

The drive member 108 includes a projection 112 extending from a surface thereof. The projection 112 provides a pivot connection for a control mechanism, as will be further described below.

The driven member 114 includes a coupling recess 118 formed at a central portion thereof around the axle 106. The coupling recess 118 is configured to receive a correspondingly shaped coupling projection 130 formed on a spool 128, as will be discussed below in further detail.

As best illustrated in FIGS. 2, 3, 6, and 7, a lock member or lever 120 is pivotally connected to the base 102 at the pivot point 122. The lock member 120 includes an engaging portion 124 that is configured to selectively engage the projections or teeth 116 of the driven member 114 in order to allow free rotation of the driven member 114 in a first direction and to selectively prevent or allow rotation of the driven member 114 in a second direction. The engaging portion 124 can include a sloped surface that passes along and over the sloped surfaces of the projections or teeth 116 when the driven member 114 rotates in a first direction such that the driven member 114 is freely rotatable in the first direction. The engaging portion 124 can also include a linear surface that is configured to engage the linear surface cut-outs on the back portion of the projections or teeth 116, such that rotation of the driven member 114 in a second direction is prevented via the engagement of the two respective linear surfaces.

A biasing member or spring 126 is arranged between the engaging portion 124 of the lock member 120 and a housing 144. The biasing member 126 biases the lock member to a locking position to prevent rotation of the driven member 116 in the second direction by causing the engaging portion 124 to engage the projections or teeth 116 of the driven member 114. The biasing member 126 further allows the sloped surface of the engaging portion 124 to rise along and pass over the sloped surfaces of the projections or teeth 116. A user can manipulate the lever 120 to an unlocked position by pivoting the lever 120 about the pivot point 122 to disengage the engaging portion 124 from the projections or teeth 116 of the driven member 114 to allow the rotation thereof in the second direction.

In a variation, the lock member can be configured to selectively prevent rotation in both a first and second direction, such that a user would be required to move the lock member to an unlocked position to rotate the rotary tensioning device in either direction.

As best seen in FIGS. 5, and 8-11, a spool 128 is configured to be coupled to the driven member 114. The coupling projection 130 formed on one surface of the spool 128 is correspondingly shaped to be received within the coupling recess 118 formed in the driven member 114. In this manner, the spool 128 is configured to rotate with the driven member 114.

The spool 128 includes a wire or cable groove 132 formed between two spaced apart disks that form the top and bottom surfaces of the spool 128. A wire or cable anchor or hole 134 is formed in the groove 132 to allow a wire or cable 136 to pass therethrough or to be anchored in the groove 132. If the wire 136 passes through the hole 134, the wire 136 can be anchored to a side of a recess formed in a central portion of the spool 128.

Figure 10:
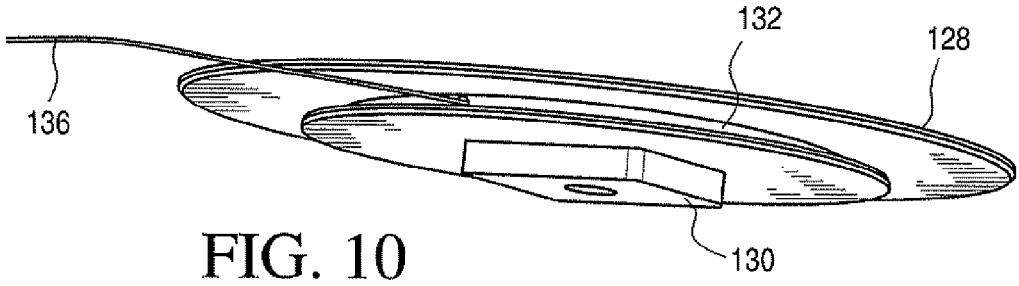
FIG. 10 is a bottom perspective view of the spool of FIG. 8.
Figure 11:
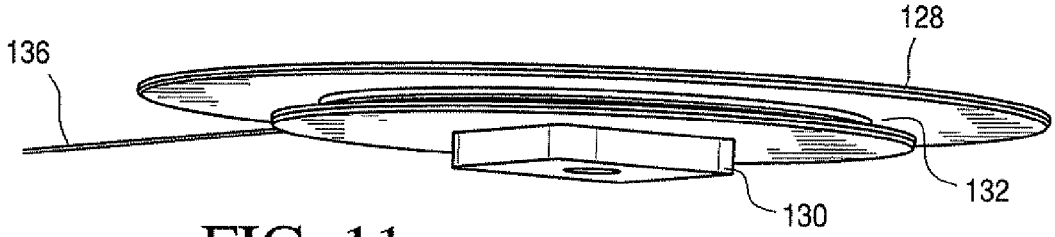
FIG. 11 is a bottom perspective view of the spool of FIG. 8 rotated to take up the wire or cable.

As shown in FIGS. 10 and 11, the wire 136 extends from the hole or anchor 134. Rotation of the spool 128 in a first direction causes the wire 136 to be taken up and wound around the spool 128 within the groove 132 in order to apply tension to the wire 136.

Figure 8:
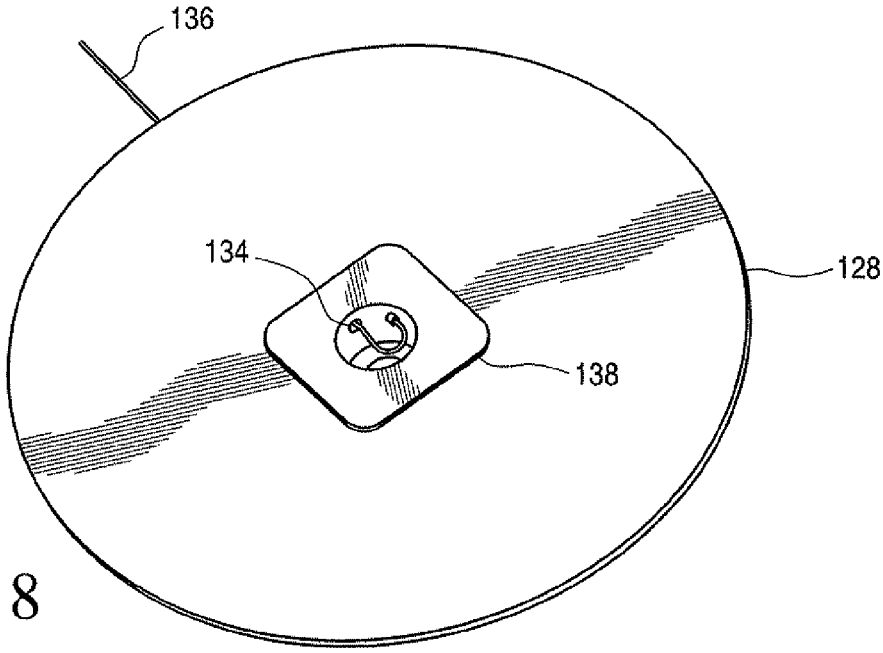
FIG. 8 is a top perspective view of the spool of the embodiment of FIG. 1.
Figure 9:
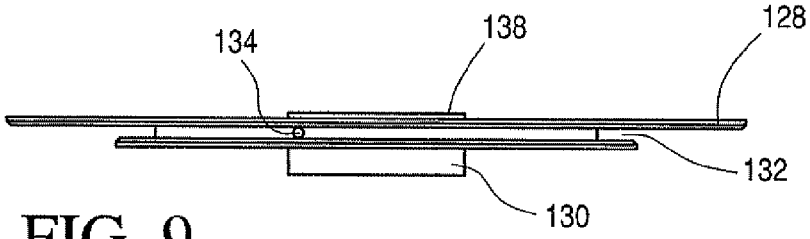
FIG. 9 is a side view of the spool of FIG. 8 (with the wire or cable removed)

As shown in FIGS. 5, 8, and 9, a second coupling projection 138 is formed on the top surface of the spool 128 for coupling an indicator member 140 thereto. The indicating member 140 is in the form of a partial disk, which may be colored, painted, patterned, include lines, numbers, or other markings or indicia, or is otherwise contrasting in order to be distinguishable from the upper surface of the spool 128. The indicating member 140 includes a coupling cut out 142 in a central portion thereof that is complementary shaped with the second coupling projection 138 formed on the top surface of the spool 128 so that the indicating member 140 rotates concurrently with the spool 128. As described below, the indicating member 140 cooperates with a view portion or window 146 in the housing 144 to indicate to the user the amount of tension being applied to the wire 136.

As best seen in FIGS. 2 and 3, a housing 144 is arranged to at least partially enclose the spool 128, the indicating member 140, and the driven member 114. The housing has appropriate openings or apertures to allow the wire 136 and the locking member 120 to extend therethrough. The housing further has an appropriate opening or aperture to allow meshing of the drive member 108 with the driven member 114.

Additionally, the housing 144 includes a view portion 146 in a top surface thereof which may be formed as an open cut out in the housing or a cut out enclosed with a transparent window portion. As can be seen, tension marks 148 are arranged along the outer periphery of the view portion 146. Of course, the location of the tension marks 148 may be altered, such as, for example, along an inner periphery of the view portion 146. The tension marks may also be indicated with lines and/or numbers to provide an indication of the degree of tensioning. As will be discussed in more detail below, the tension marks 148 cooperate with the contrast between the spool 128 and the indicating member 140 to indicate to a user the amount of tension being applied to a wire 136.

As best shown in FIGS. 1-6, a control mechanism in the form of a flip up handle 150 is pivotally connected to the drive member 108 at the pivot 152 attached to the projection 112. The pivot 152 can be formed of flanges extending from the handle 150 to sit astride opposed sides of the projection 112. A pivot pin is inserted through a clearance hole defined between the two opposed sides of the projection 112, and is press fit, secured by adhesive, or mechanically secured into each flange of the handle.

As can be seen from the illustrations, the handle 150 has at least a non-use position, in which the handle 150 is pivoted to lie flush against the upper surface of the housing 144, and a use position, in which the handle 150 is pivoted to a substantially orthogonal upright position.

This configuration of a flip up handle provides the benefits of a low profile rotary tensioning device, such that when the handle 150 is in the non-use position, the rotary tensioning device is less likely to be hung up on objects. Therefore, the rotary tensioning device is less subject to damage. Further, when the rotary tensioning device is placed upon wearable devices or articles, the wearer or user is less likely to suffer an injury from being thrown off balance or falling over due to the rotary tensioning device catching on other objects.

In addition to the benefits of providing a low profile rotary tensioning device, this configuration also provides an easily manipulated handle 150 in the use position, such that infirm or elderly users, as well as ordinary users, can easily manipulate the handle to provide tensioning. Thus, this disclosed embodiment achieves the benefits of a low profile rotary tensioning device, while also avoiding drawbacks typically associated with a low profile rotary tensioning device.

Referring again to FIGS. 1-4, it is seen that the handle 150 has a shape generally corresponding to the shape of the housing 144, such that when the handle 150 is pivoted to the non-use position, the handle 150 and the housing 144 form a generally contiguous, low profile structure. The handle 150 is thus generally in the shape of a substantially planar disk that provides two opposed surfaces for grasping by a user to rotate the handle 150, and thus the drive member 108, the driven member 114, and the spool 128.

In order to allow the user to manipulate the handle 150 from the non-use position to the use position, a lip portion 154 is provided at one end thereof. The lip portion 154 extends beyond the periphery of the housing 144, so that, even though when the handle 150 is in the non-use position and forms a generally contiguous structure with the housing 144, a user may grasp or otherwise engage the lip portion 154 to pivot the handle 150 from the non-use position to the use position.

As generally depicted in FIGS. 2 and 3, the rotation of the handle 150 causes rotation of the drive member 108, the driven member 114, the spool 128, and the indicating member 140. As can be seen from the figures, rotation of the handle thus causes the contrasting or differently colored indicating member 140 to rotate within the view portion 146 of the housing 144. The contrasting or differently colored indicating member 140 forms an edge with the spool 128, such that the edge defines the extent of the contrasting or differently colored indicating member 140. The edge between the contrasting or differently colored indicating member 140 and the spool 128, in conjunction with the tension indicators 148, provide a user with a mechanism to indicate the amount of tension being applied to the wire 136. In this manner, the amount of tension being applied to the wire 136 is reproducible between successive tensioning, loosening, and tensioning again of the wire 136. This provides users, in particular users wearing an orthopedic device, with a mechanism to provide the same tension or dosage between successive uses of the device. In other words, on two or more different days of wearing and removing a device, the same amount of tension can be easily applied on each day.

As previously discussed, the locking member 120 allows rotation of the driven member 114, via rotation of the handle 150 and drive member 108, in a first direction to take up the wire 136 around the spool 128. The wire 136 can be unwound from the spool 128 by manipulating the locking member 120 to an unlocked position and either rotating the handle 150 in a second direction or by pulling the wire 136 away from the spool 128 to cause the spool 128 to rotate in a second direction to unwind the wire 136 therefrom. Due to the tension present in the wire 136, there will naturally be a tendency for the spool to begin rotating in the second direction upon release of the locking member 120. The driven member 114 and the drive member 108 can either be configured such that rotation of the driven member 114 in the second direction either causes rotation of the drive member 108 in a corresponding second direction, or alternatively, does not cause rotation of the drive member 108.

C. Detailed Discussion of a Variation of a Spool for Use in a Rotary Tensioning Device A variation of a spool 168 for use with the rotary tensioning device 100 is shown in FIGS. 12-15. The spool 168 has generally the same configuration as spool 128, but may be used for providing tension to two wires connected to two distinct straps. The spool 168 includes two opposed holes 134 defined within the groove 132. A wire 136 is passed through each of the holes to extend from both sides of the spool 168.

Figure 12:
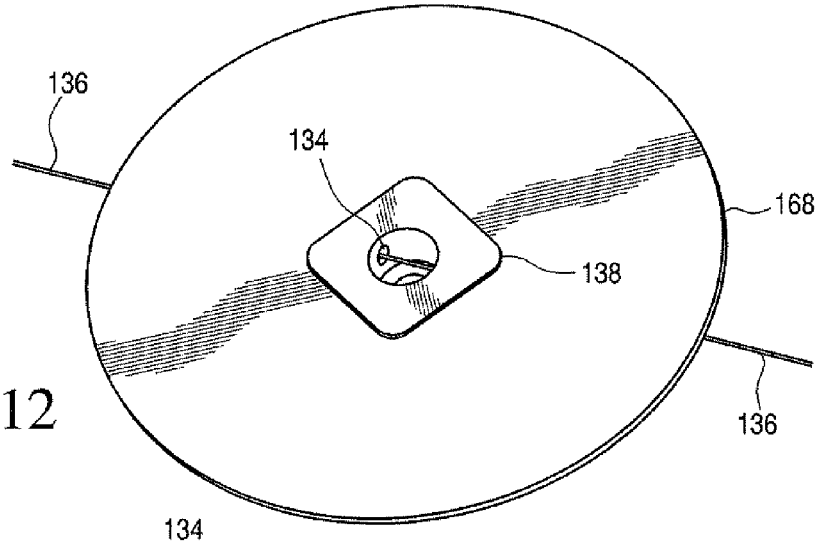
FIG. 12 is a top perspective view of a variation of the spool of FIG. 1.
Figure 13:
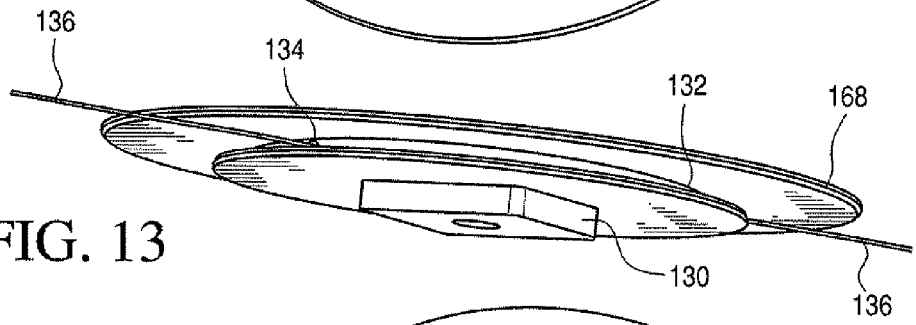
FIG. 13 is a perspective view of the spool of FIG. 12.

As shown in FIGS. 12 and 13, the wire 136 extends from two opposed sides of the spool 168. The spool is then rotated approximately 180 degrees, or one end of the wire 136 is wrapped around the spool 168 within the groove 132 until both ends of the wire 136 extend generally from the same side of the spool 168.

Figure 14:
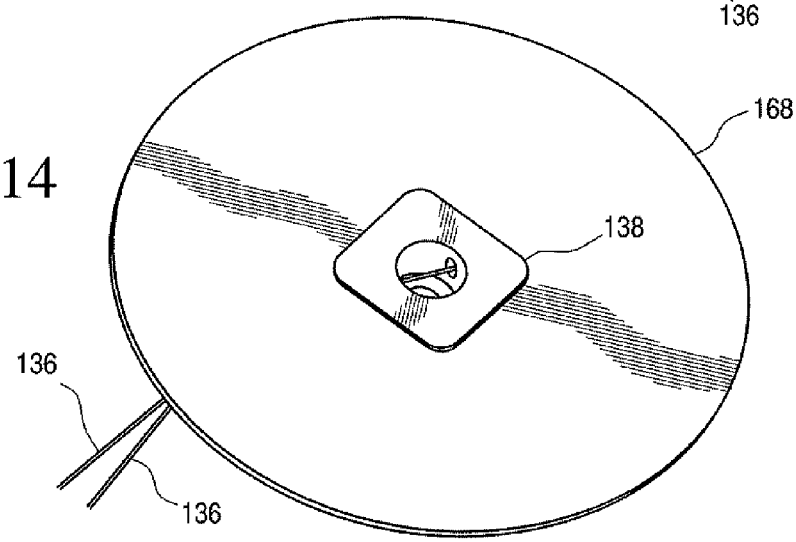
FIG. 14 is a top perspective view of the spool of FIG. 12 rotated to take up the wire or cable.
Figure 15:
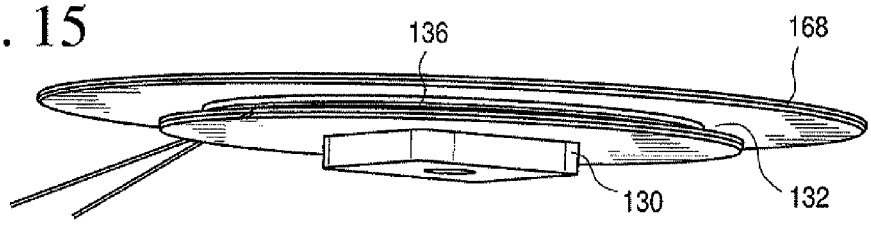
FIG. 15 is a perspective view of the spool of FIG. 14.

As shown in FIGS. 14 and 15, once the ends of the wire 136 extend from the same side of the spool 168, essentially two wires are provided. Each of the two wires can then be connected to respective straps so that the rotary tensioning device can be used to provide tensioning to two straps simultaneously.

It is contemplated that the use of two stacked spools 168 would allow the simultaneous tightening of four straps, and additional stacked spools may be used to tighten a desired number of straps simultaneously.

D. Detailed Discussion of an Exemplary Use of a Rotary Tensioning Device

An exemplary use of a rotary tensioning device 100 is shown in FIGS. 16 and 17. The rotary tensioning device 100 is used in conjunction with a strap 156 for tightening thereof. The strap 156 is connected to a base or support at one end (not shown) and is attached to a wire 136 at the opposed end. The rotary tensioning device 100 is similarly attached to a base or support and is utilized to apply tension to the strap 156.

The wire 136 is connected at both ends to a spool of the rotary tensioning device 100 in a manner previously discussed in order to form a loop extending from the spool. The strap 156 is connected to the loop via a strap clasp 158.

The strap clasp 158 is hinged 160 at a midpoint thereof in order to fold over an end portion of the strap 156 that is itself folded over the loop, as shown in FIG. 17. Retention projections 162 are provided on each of the divided surfaces of the strap clasp 158 for engagement with the strap 156 to prevent the strap 156 from being removed from the strap clasp 158.

The ends of the respective divided surfaces of the strap clasp 158 are formed with locking projections 164 and locking recesses 166 to allow the strap clasp 158 to be closed over the folded end of the strap 156. The locking projections 164 and locking recesses 166 can be in the form of snap fitting projections and recesses to allow selective opening and closing of the strap clasp 158 in order to allow the strap 156 to be disengaged from the strap clasp 158. This feature can be used for such wearable devices as orthopedic braces, so that a user may remove the brace when the use thereof is not necessary.

The rotary tensioning device 100 functions as previously discussed, such that rotation of the handle 150 in direction A causes rotation of the spool and indicating member in direction B, which translates to a tightening of the strap 156 in direction C.

E. Detailed Discussion of Another Exemplary Use of a Rotary Tensioning Device

Another exemplary use of a rotary tensioning device 100 is shown in FIGS. 18-22. In this exemplary embodiment, the rotary tensioning device 100 is connected to a support member 170. The support member 170 further includes a slot or slots (FIG. 19) 172 that allow mounts 174 for straps 180 to translate therein.

The rotary tensioning device 100 for this configuration can utilize the spool 168 described above to provide simultaneous tightening of two straps during rotation of the rotary tensioning device 100 in direction D. Each of the straps 180 is connected to a wire 136 that passes through a wire slot 178 in the respective mount 174.

Figure 18:
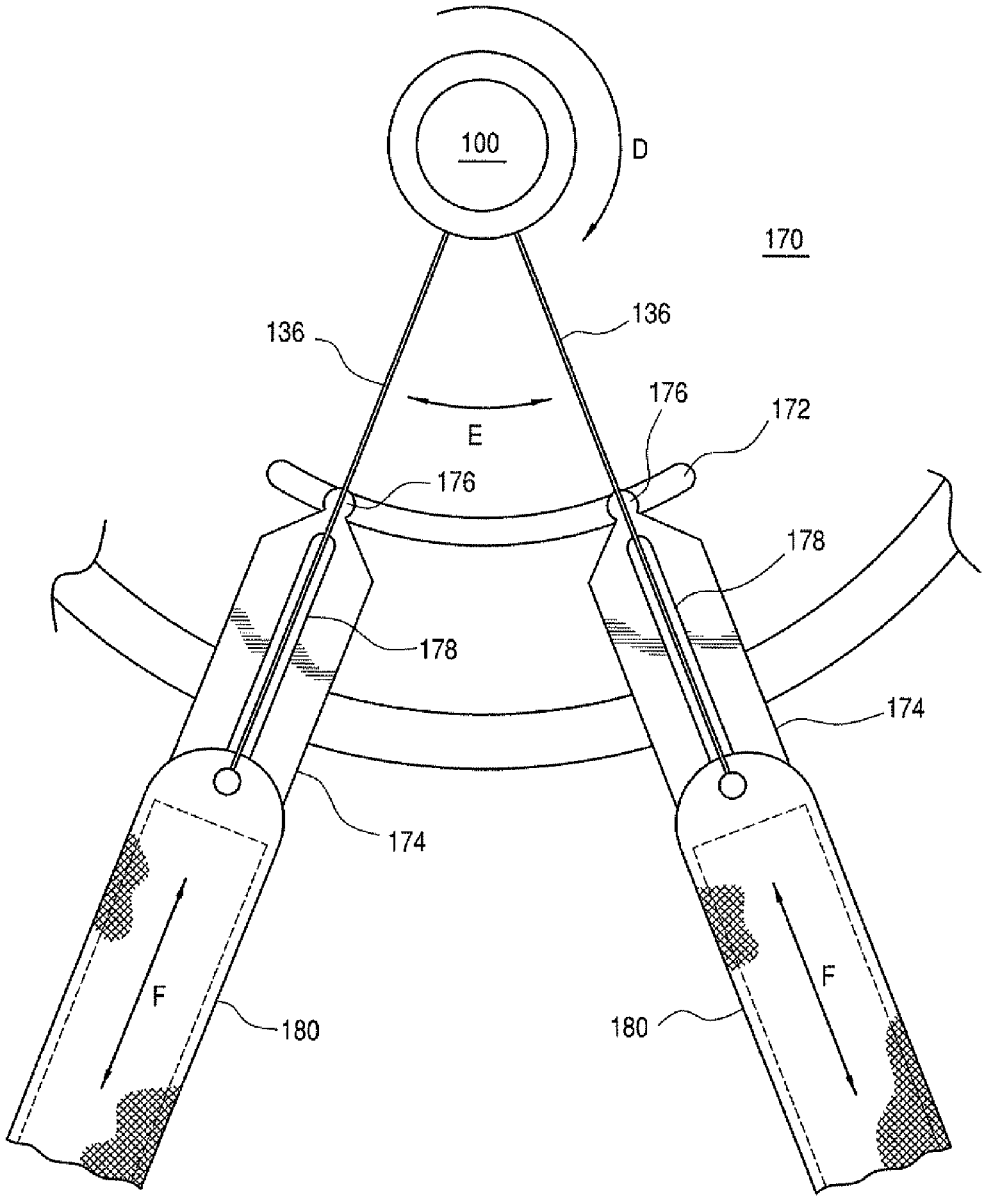
FIG. 18 is a top view of another variation of the implementation of the rotary tensioning device of FIG. 1 shown in combination with a support member and two straps to be tightened.

As shown in FIGS. 20-22, the mounts 174 include a projection 176 that fits within and travels along the slot/s 172 to allow the straps 180 to translate in the direction indicated at E (FIG. 18). A similar projection can be provided at the end of the straps 180 where the wires 136 attach thereto in order to aid with maintaining the straps 180 along the mounts 174 in direction F (FIG. 18) during tensioning thereof. The wires 136 are retained in the wire slots 178 to further aid with providing tensioning of the straps 180 along the direction F.

The exemplary configuration of FIGS. 18-22 allows a user to tension two straps simultaneously in a first direction, and also provides some lateral strap adjustment as needed, for example, to accommodate different geometries of a portion of an anatomy of a user.

F. Conclusion

The disclosed embodiments of a rotary tensioning device provide an improved low profile rotary tensioning device that provides an easily manipulated control mechanism for elderly or infirm persons.

It is understood that the size of the rotary tensioning device and the components thereof can be adjusted according to the needs of the tightening system.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The skilled artisan will recognize the interchangeability of various features from different embodiments. In addition to the variations described herein, other known equivalents for each feature can be mixed and matched by one of ordinary skill in this art to construct a rotary tensioning device in accordance with principles of the present invention.

Although this invention has been disclosed in the context of certain exemplary embodiments and examples, it therefore will be understood by those skilled in the art that the present invention extends beyond the specifically disclosed embodiments to other alternative embodiments and/or uses of the invention and obvious modifications and equivalents thereof.

Thus, it is intended that the scope of the present invention herein disclosed should not be limited by the particular disclosed embodiments described above.

What is claimed is:

1. A rotary tensioning device comprising:

a base portion;

a drive member rotatably positioned on the base portion;

a driven member rotatably positioned on the base portion and configured to be rotated by rotation of the drive member;

a housing at least partially surrounding the driven member; and a handle pivotally connected to the drive member and configured to:

(a) lie flush against the housing in a non-use position; and (b) to rotate the drive member in a use position;

at least one spool coupled to the driven member and rotatable therewith, the spool configured to allow a wire to be taken up and wound thereon and unwound therefrom;

an indicator member coupled to the spool and rotatable therewith and visible through a view portion of the housing.

2. The rotary tensioning device according to claim 1 further comprising:

a selectively releasable lock member configured to allow free rotation of the driven member in a first direction and to selectively allow or prevent rotation of the driven member in a second direction.

3. The rotary tensioning device according to claim 1 wherein the indicator member is in the form of a partial disk that contrasts with an upper surface of the spool in order to be distinguishable therefrom.

4. The rotary tensioning device according to claim 1 further comprising:

marks arranged along an outer periphery of the view portion of the housing such that the marks cooperate with the contrast between the spool and the indicator member to indicate an amount of tension.

5. The rotary tensioning device according to claim 1 wherein the spool includes a groove formed between two spaced apart disks and a first hole defined within the groove.

6. A rotary tensioning device comprising:

a base portion;

a drive member rotatably positioned on the base portion;

a driven member rotatably positioned on the base portion and configured to be rotated by rotation of the drive member;

a housing at least partially surrounding the driven member; and a handle pivotally connected to the drive member and configured to:

(a) lie flush against the housing in a non-use position; and (b) to rotate the drive member in a use position;

wherein the handle has a shape generally corresponding to a shape of the housing such that when the handle is in the non-use position, the handle and the housing form a generally contiguous, low profile structure;

wherein the handle is generally in the form of a substantially planar disk having two opposed surfaces configured for grasping by a user, and the handle further comprises a lip portion provided at one end thereof such that when the handle is in the non-use position, the lip portion extends beyond a periphery of the housing.

* * * * *